United States Patent [19]

Tada

[11] 4,259,759

[45] Apr. 7, 1981

[54] CONCRETE BRIDGE GIRDER SUPPORT STRUCTURE AND CANTILEVER ERECTION METHOD USING SAME

[75] Inventor: Hiroshi Tada, Yokohama, Japan

[73] Assignee: Oiles Industry Co. Ltd., Tokyo, Japan

[21] Appl. No.: 12,387

[22] Filed: Feb. 15, 1979

[30] Foreign Application Priority Data

| | | | |
|---|---|---|---|
| Feb. 16, 1978 | [JP] | Japan | 53/15890 |
| Jul. 12, 1978 | [JP] | Japan | 53/84083 |
| Sep. 22, 1978 | [JP] | Japan | 53/130419[U] |

[51] Int. Cl.[3] ..... E01D 19/06

[52] U.S. Cl. ..... 14/16.1; 14/1; 248/544; 52/299; 308/3 R

[58] Field of Search ..... 52/299; 14/16.1, 1, 14/17; 248/22; 308/3 R

[56] References Cited

U.S. PATENT DOCUMENTS

| | | | |
|---|---|---|---|
| 2,680,259 | 6/1954 | Milk | 14/16.1 |
| 3,105,252 | 10/1963 | Milk | 14/16.1 |
| 3,299,191 | 1/1967 | Mantscheff | 14/1 X |
| 3,325,842 | 6/1967 | Spencer | 14/16.1 |
| 3,490,605 | 1/1970 | Koss | 14/1 X |
| 3,571,835 | 3/1971 | Buechler | 14/1 |
| 3,806,975 | 4/1974 | Fyfe | 14/16.1 |
| 3,971,598 | 7/1976 | Rudge | 308/3 R |
| 3,979,787 | 9/1976 | Ahlgren | 14/16.1 |

*Primary Examiner*—Nile C. Byers, Jr.
*Attorney, Agent, or Firm*—George B. Oujevolk

[57] ABSTRACT

A concrete bridge girder support structure for use in a cantilever erection method is disclosed. The support structure comprises an upper shoe for use as a fixture to the girder through a sole plate fixed to the girder at a predetermined position, a lower shoe fixed on a pier and abutment, a movable part(s) disposed between the upper and lower shoes, and a movable plate placed for bridge-axial movement relative to the upper shoe. A concrete bridge girder erection method using such a support structure is also disclosed. The girder having the sole plate fixed thereto at the predetermined position is carried on the movable plate and continuously advanced along the upper shoe up to a predetermined erection position with bridge-axial movement of the movable plate. At the erection position, the sole plate is integrally fixed to the upper shoe of the support structure.

19 Claims, 15 Drawing Figures

CONCRETE BRIDGE GIRDER SUPPORT STRUCTURE AND CANTILEVER ERECTION METHOD USING SAME

BACKGROUND OF THE INVENTION

1. Field of the Invention:

This invention relates to a concrete bridge girder support structure and also to a cantilever erection method using such a support structure.

2. Description of the Prior Art:

Heretofore, several ways have been utilized in concrete bridge girder cantilever erection method to advance a concrete bridge girder produced, on a table located behind the abutment, in unit form having a length ranging from several meters to tens of meters after the concrete has solidified for the cantilever erection method of the girder on a bridge pier. For example, it is common to utilize a pushing device installed on the bridge pier to push or pull the girder having a hand garter secured thereto in sliding contact with a sliding member placed on a temporary carrier table such as a steel table or concrete block installed on the bridge pier. It is also common to utilize a horizontal jack to push or pull, along a flat plate fixed on the bridge pier, a movable carrier table having the girder carried thereon.

However, such conventional ways present many difficulties. One of the difficulties particularly with the latter way is a limited stroke distance of sliding movement of the movable carrier table, resulting in a need for a separate vertical jack to lift up the girder when the movable carrier table is intended to return to its original position at each stroke end. Furthermore, it is required in either of these conventional ways to remove the temporary carrier table and instead place a perpetual bearing device after the girder arrives at a predetermined erection position and erected thereat. In addition, the removal of the temporary carrier table will often require trouble and uneconomical hand work because of a narrow space between the girder and the pier.

SUMMARY OF THE INVENTION

It is a main object of the present invention to provide support structure for use in cantilever erection method in which a concrete bridge girder having a sole plate fixed thereto is continuously advanced up to a predetermined erection position.

Another object of the present invention is to provide a support structure for use in a cantilever erection method in which a perpetual support structure can be used from the beginning of girder erection without the need for any temporary support structure and which serves as a temporary support structure upon girder erection and serves as a desired type of support structure after girder erection.

Still another object of the present invention is to provide a support structure for use in girder cantilever erection which includes mounting means which are more effective to positively support the sole plate fixed to the girder and the upper shoe of the support structure under horizontal loads exerting on the girder after girder erection.

BRIEF DESCRIPTION OF THE DRAWINGS

Other objects, features and advantages of this invention will become more apparent from the detailed description of the preferred embodiments which follow, when considered in light of the accompanying drawings in which.

DETAILED DESCRIPTION OF THE PREFERRED EMBODIMENTS OF THE INVENTION

Figure 1:
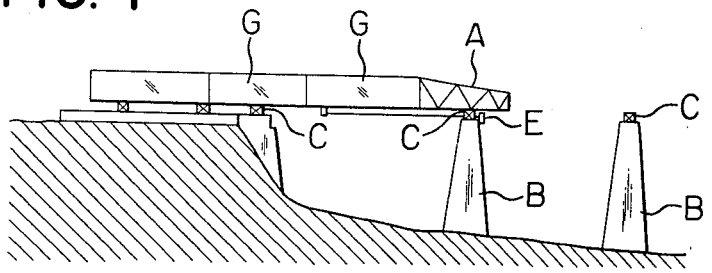
FIG. 1 is a schematic view showing the principles of girder cantilever erection method.

On a bridge pier B there is installed a support structure 1 for bearing a girder G. The support structure 1 comprises a lower shoe 2, an upper shoe 3, a movable part(s) 4 disposed between the upper and lower shoes for allowing changes in girder position such as its inclination and tolerating girder expansion and contraction, and a long movable plate 6 placed for bridge-axial movement along the upper shoe through a sliding member 7 placed on the upper surface of the upper shoe 3. The term "movable part(s)" as used throughout this invention is intended to mean the roller or rocker section in roller bearings, the pin section in hinge bearings, the slide plate section or bearing plate section having a curved surface in sliding bearings, the rubber section in rubber bearings, and any suitable combination of these elements which will accomplish the purpose of allowing changes in girder position such as its inclination and tolerating girder expansion and contraction.

The present invention will be described hereinafter in connection with a support structure including a movable section having a bearing plate disposed between the upper and lower shoes and having a curved surface.

The lower shoe 2 is fixed on the bridge pier B and abutment such as by anchor bolts and has its upper surface formed with a concave surface 21. Resting on the lower shoe 2 is a bearing plate 8 which has a flat upper surface 82 and a convex lower surface 81 in sliding engagement with the concave surface 21 of the lower shoe 2. The bearing plate 8 is disposed between the upper and lower shoes and constitutes the movable section 4 of the support structure 1. The lower shoe 2 has at its bridge-axially opposite end upwardly extending arms 22 and 22.

The upper shoe 3 has a flat upper surface 31 for sliding engagement with a sole plate to be described later and a flat lower surface 32 in sliding contact with the flat surface 82 of the bearing plate 8 placed on the concave surface 21 of the lower shoe 2. The upper shoe 3 has at its opposite ends in the direction perpendicular to the bridge axis stepped portions 33 and 33 each of which is formed centrally with a cutout 35 to form projections 34 and 34 at the bridge-axially opposite sides of the cutout 35. The cutouts 35 and 35 receive the respective arms 22 and 22 of the lower shoe 2. The upper shoe 3 is formed at its bridge-axially opposite ends with threaded holes 36 and 36 in which bolts can be threadedly engaged for attachment of a sole plate to be described later to the upper shoe 3. Fixed to each arm 22 of the lower shoe 2 such as by bolting is a hook-shaped side-block 9 for restricting vertical movement of the stepped portion 33 of the upper shoe 3.

The sliding member 7 disposed between the upper surface 31 of the upper shoe 3 and the movable plate 6 is formed of synthetic resin having a low coefficient of friction such as, for example, polytetrafluoroethylene resin, polyamide resin, polyethylene resin, or the like. For the purpose of restricting bridge-axial movement of the upper shoe 3 relative to the lower shoe 2 upon girder erection, stopper members 10 and 10 are disposed in the spaces between the arms 22 and 22 of the lower shoe 2 and the walls of the cutouts 35 and 35 of the upper shoe 3. The sliding member 7 is fixedly held on the upper surface 31 of the upper shoe 3 by means of a holder member 11.

A sole plate 12 is previously embedded in the girder at a predetermined position upon formation of the girder G. The sole plate 12 is previously embedded in the girder G by means of anchor bolts or the like at a position for agreement with the support structure 1 fixed on the bridge pier B and abutment after girder erection. The sole plate 12 has its lower surface flattened on level with the lower surface of the girder G. Normally, girders such as bridge beams are supported by the combination of a movable bearing adapted to allow the girder to move a limited distance axially of the bridge and a fixed bearing adapted to restrict bridge-axial movement of the girder G.

The support structure 1 can be used as a movable bearing by removing, after the erection of the girder, the stopper members 10 and 10 disposed between the lower and upper shoes 2 and 3, i.e. the stopper members 10 and 10 disposed in the spaces between the arms 22 and 22 of the lower shoe 2 and the cutouts 35 and 35 of the upper shoe 3 for restricting bridge-axial movement of the upper shoe relative to the lower shoe upon girder erection. That is, the removal of the stopper members 10 and 10 after girder erection produces clearances between the arms 22 and 22 of the lower shoe 2 and the walls of the cutouts 35 and 35 of the upper shoe 3 to allow a limited bridge-axial displacement of the girder G and the support structure 1 serves as a movable bearing. The support structure 1 can also be used as a fixed support by leaving the stopper members 10 and 10 to fix the upper shoe 3 with respect to the lower shoe 2 after girder erection. In this case, there is no clearance between the arms 22 and 22 of the lower shoe 2 and the walls of the cutouts 35 and 35 of the upper shoe 3 and the support structure 1 serves as a fixed support to restrict bridge-axial movement of the girder G. It is to be noted that the support structure 1 can be used as a fixed support without use of the stopper members 10 and 10 by designing it such that the clearances between the arms 22 and 22 of the lower shoe 2 and the walls of the cutouts 35 and 35 of the upper shoe 3 are very narrow.

Figure 2:
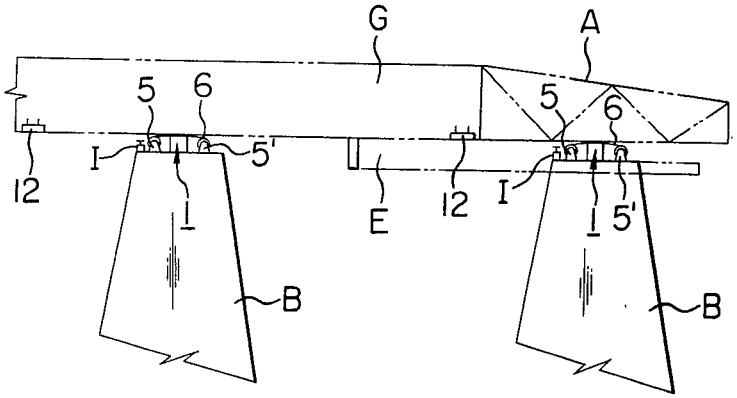
FIG. 2 is a view used to explain a concrete bridge girder cantilever erection method using support structure constructed in accordance with the present invention.

The present invention will be described hereinafter in connection with girder erection in which the stopper members are disposed in the spaces between the arms of the lower shoe and the walls of the cutouts of the upper shoe and then they are removed therefrom so that the support structure 1 is used as a movable bearing after girder erection. Support structure and a vertical jack for lifting and lowering the girder G are installed on the bridge pier B and abutment (see FIG. 2). The sole plate 12 is embedded at a predetermined position of the girder G on a manufacture table located behind the abutment and a hand garter A is fixed to one end of the girder G for guiding movement of the girder G. The girder G produced in such a manner is carried on the movable plate 6 of the support structure 1 installed on the bridge pier B. Thereafter, the girdger G is advanced together with the movable plate along the upper surface 31 of the upper shoe 3 axially of the bridge (in the arrow X direction of FIG. 3) by the use of a pushing device E installed on the girder G. Concrete depositing is effected with continuous advancing the girder G until the sole plate 12 fixed to the girder G reaches the support structure 1 installed on a bridge pier B and abutment. The girder G is then lifted by the use of the vertical jack I after the arrival of the girder at the predetermined position. Under this conditions, the stopper members 10 and 10 disposed between the upper and lower shoes of the support structure 1 for restricting bridge-axial movement of the upper shoe with respect to the lower shoe upon girder erection, the sliding member 7 placed on the upper surface of the upper shoe, the holder member 11 fixedly holding the sliding member 7 on the upper surface of the upper shoe, and the movable plate 6 are removed. Successively, the girder G is lowered by the use of the vertical jack I and the sole plate 12 embedded in the girder G is placed on the upper shoe 3 of the support structure. Then, the sole plate 12 is fixed integrally on the upper shoe 3 by means of bolts threadedly engaged in the holes 36 of the upper shoe. Following this, the pushing device E and the vertical jack I are removed.

In this girder erection method, the movable plate 6 carrying thereon the girder G formed of concrete and placed on the sliding member 7 fixed on the upper shoe 3 for sliding movement therealong with a low frictional force upon advancing movement of the girder G permits a smooth advancing movement of the girder together with the movable plate 6 on the support structure.

Figure 7:
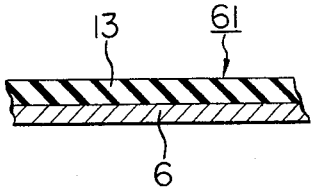
Figure 8:
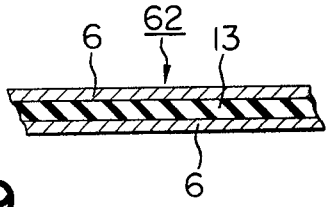

Although the movable plate 6 has been described as a long thin steel plate, it may be a composite plate 61 such as shown in FIG. 7 including a thin steel plate 6 and a rubber resilient plate 13 integrally stacked on one surface of the steel plate 6, or a composite plate 62 such as shown in FIG. 8 including a rubber resilient plate 13 sandwiched between two thin steel plates 6 as a unit. The use of such a composite plate 61 or 62 as the movable plate has the advantage of absorbing ruggedness on the surface of the girder G in sliding contact with the movable plate 6 so as to prevent deformation of the movable plate 6 and thus damage to the sliding member 7 in sliding contact with the movable plate 6.

Preferably, the movable plate 6 is formed of stainless steel having high corrosion resistance. The movable plate 6 may be formed of rolled steel strip having its one surface, which is to be set in sliding contact with the sliding plate 7, given a surface treatment so as to exhibit high corrosion resistance and high lubricity such as metal plating, coating of solid lubricant or synthetic resin such as polytetrafluoroethylene resin, polyamide resin, polyethylene resin, or the like.

Preferably, the movable plate 6 has one end wound around a holder device 5 installed on the bridge pier B and abutment so that the movable plate 6 can be continuously supplied onto the upper surface of the upper shoe 3 therefrom. The holder device 5 comprises a base 51 bolted on the bridge pier B and abutment, a drum 52 rotatably mounted on the base 51, a push lever 53 pivoted to the base 51, a roller 54 rotatably attached to the tip end of the push lever 53, and a spring 55 continuously urging the push lever 53 upward (toward the girder). In such a holder device 5, the push lever 53 continuously pushing the movable plate 6 through the roller 54 against the girder G can tolerate any slight vertical displacement of the girder G. The other end of the movable plate 6 having its one end wound around the drum 52 of the holder device 5 is located on the sliding member placed on the upper shoe.

An additional holder device 5' similar in structure to the first described holder device 5 may be installed on the side of the bridge pier B and abutment opposite the holder device 5 with respect to the lower shoe 2 so that the holder device 5 can feed out the movable plate 6 onto the upper shoe and the other holer 5' can take up the movable plate 6 during girder erection.

The above arrangement in which a pair of holder devices 5 and 5' are installed with a bridge-axial distance on the opposite sides of the bridge pier B with respect to the lower shoe 2 is the most preferable form for girder erection, and thus the figures illustrate support structure and girder erection methods utilizing this form.

Figure 9:
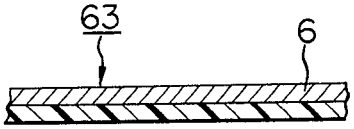
Figure 10:
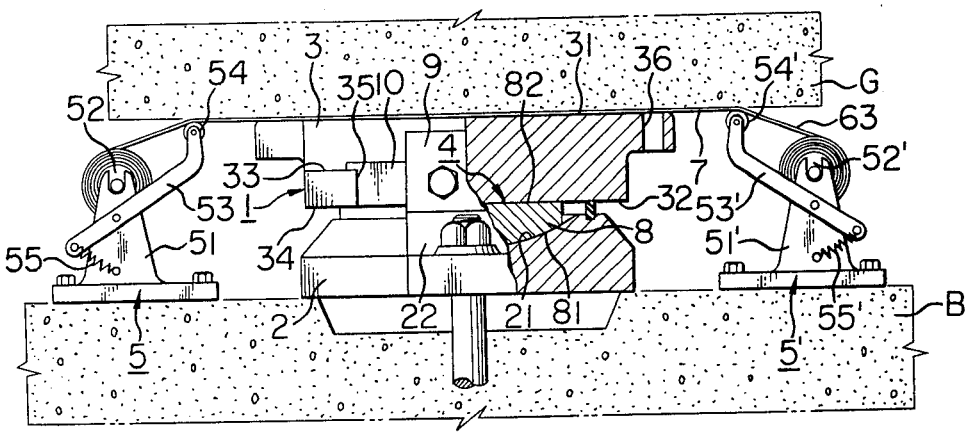
FIG. 10 is a fragmentary longitudinal section showing a support structure including the movable plate of FIG. 9, FIGS. 11 and 12 are fragmentary longitudinal sectional side views showing support structures including different types of movable section.

FIG. 9 shows another form of movable plate which includes a thin steel plate 6 integrally stacked on a sliding member 7. Such a movable plate has the function of the sliding member 7 in addition to that of the movable plate itself. FIG. 10 illustrates a support structure 1 using this form of movable plate in which the girder carried on the movable plate 63 is moved together with the movable plate having its sliding member 7 moved in sliding contact with the upper surface 31 of the upper shoe 3. This form of support structure permits removal of the movable plate 63 without the use of any vertical jack I to lift up the girder G after girder erection.

In the above-described forms of support structure, changes in girder position such as its inclination can be allowed and girder expansion and contraction can be tolerated by sliding movement of the movable section 4 disposed between the upper and lower shoes, i.e. sliding movement of the convex surface 81 of the bearing plate 8 with resepct to the concave surface 21 of the lower shoe 2, and sliding movement of the flat surface 82 of the bearing plate 8 with respect to the lower surface 32 of the upper shoe 3 after girder erection. Movement of the girder G in the directions of axial of the bridge and perpendicular to the bridge axis can be restricted by contact of the arms 22 and 22 of the lower shoe 2 against the inner walls of the respective cutouts 35 and 35, of the upper shoe.

Figure 11:
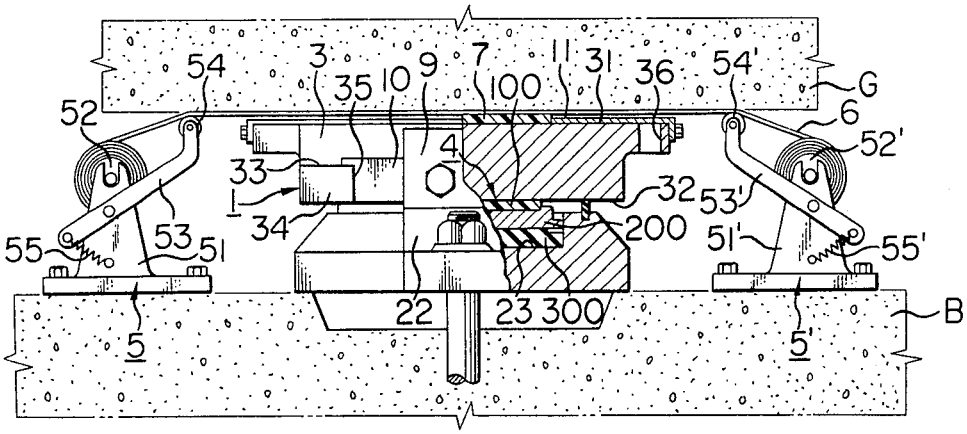
Figure 12:
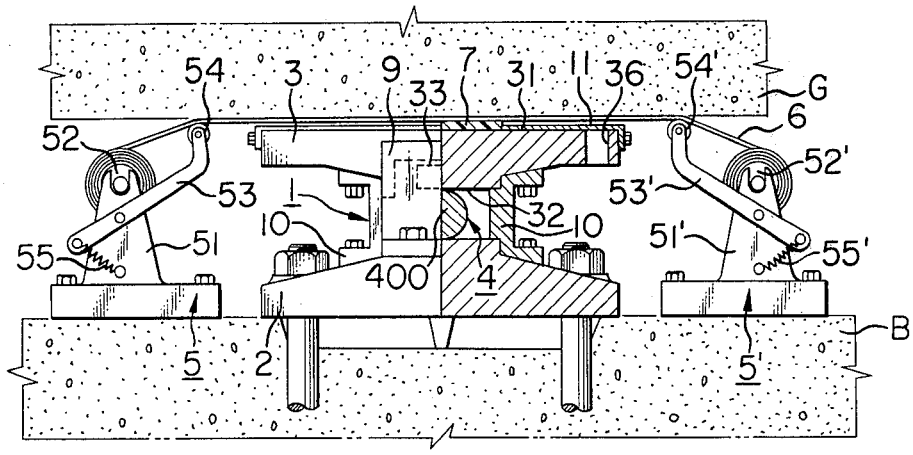

FIGS. 11 and 12 illustrate other forms of support structure which are substantially similar in structure to those previously illustrated and described except that they include other types of movable section 4 designed to have a function similar to that of the bearing plate 8. In FIG. 11 there is illustrated a sealed rubber bearing type movable section disposed between the upper and lower shoes in which the intermediate plate 200 having on its upper surface a sliding member 100 is provided to seal a rubber resilient member 300 contained in a recess 23 formed in the lower shoe 2. This type of movable section permits the lower surface 32 of the upper shoe 3 to slide along the sliding member 100 for tolerance of girder expansion and contraction and also permits deformation of the rubber resilient member 300 for allowing changes in girder position such as its inclination. FIG. 12 illustrates a roller bearing type movable section which includes a roller 400 disposed between the upper and lower shoes for rotating movement. With this type of movable section, it is also possible to tolerate girder expansion and contraction and allow changes in girder position such as its inclination by rotating movement of the roller 400.

Figure 13:
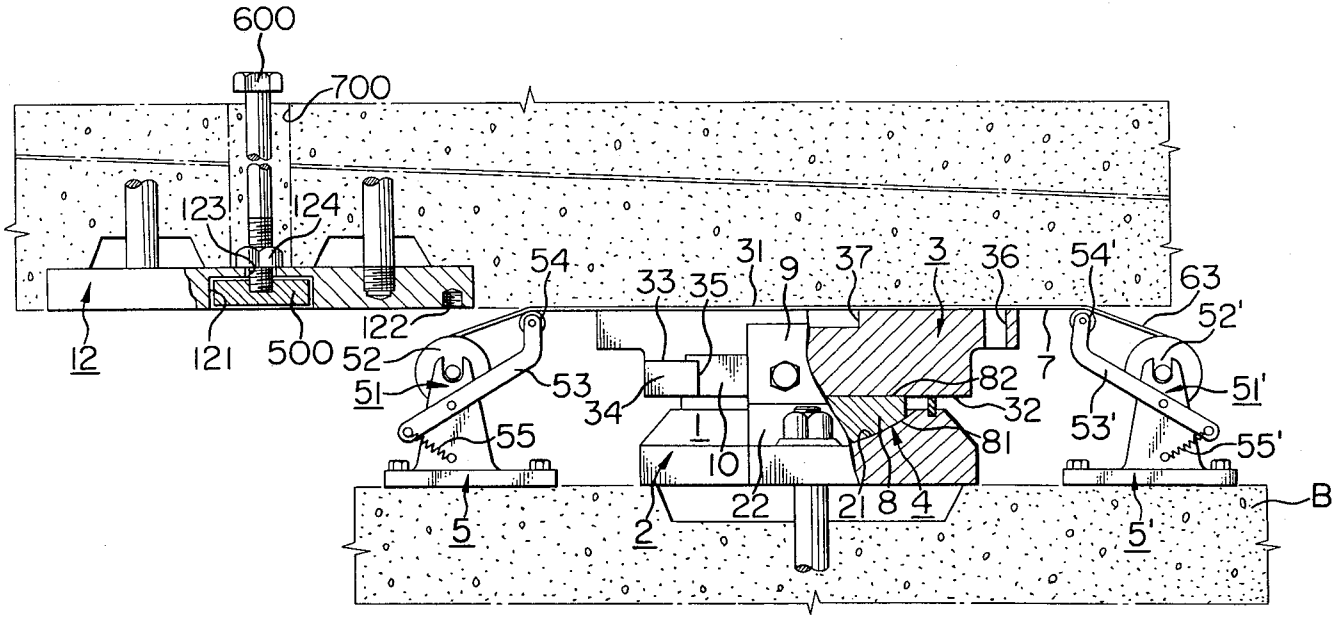
FIG. 13 is a fragmentary longitudinal sectional side view showing a support structure including the means for establishing engagement between the sole plate and the upper shoe upon concrete bridge girder erection.
Figure 14:
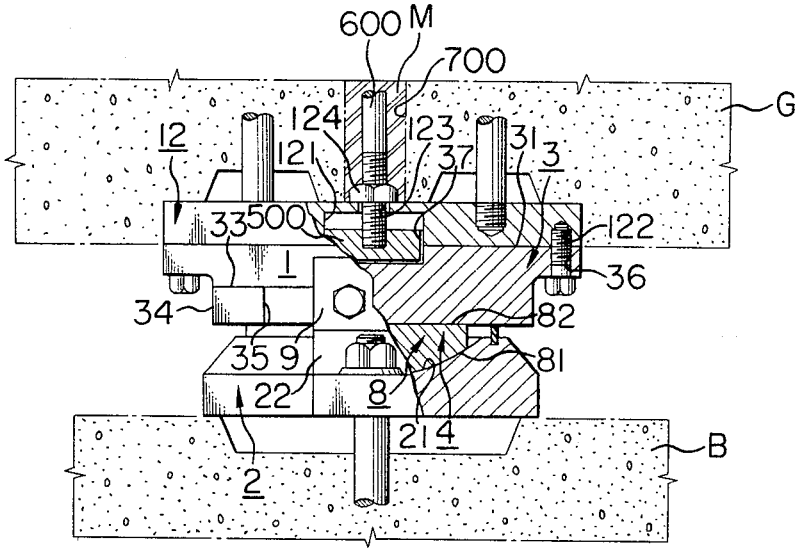
FIG. 14 is a fragmentary longitudinal sectional side view showing engagement of the sole plate with the upper shoe after concrete girder erection.
Figure 15:
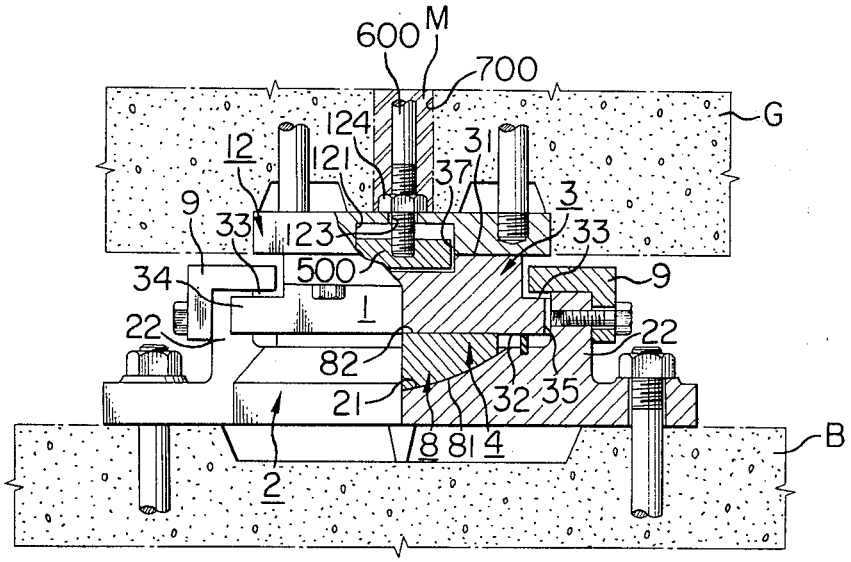
FIG. 15 is a fragmentary sectional elevation showing the engagement of FIG. 14.

While the sole plate 12 and the upper shoe 3 are fixed such as by bolts threadedly engaged in the holes 36 of the upper shoe after girder erection in the above-described forms of support structure, FIGS. 13 to 15 show still another form of support structure which is more effective to positively support the girder under horizontal loads exerting on the erected girder. The support structure shown in FIGS. 13 and 15 is substantially similar to the previously stated ones except for the structure of the upper shoe 3 and the sole plate 12. Accordingly, like parts will not be described further. A movable plate 63 as shown in FIG. 9 including a thin steel plate 6 integrally stacked on a sliding member 7 formed of synthetic resin is employed in this embodiment as a movable plate. The upper shoe 3 is formed in its upper surface 31 with a center recess 37 facing upward and formed at its bridge-axially opposite ends with holes 36 and 36 for use in fixture of the sole plate 12 to the upper shoe 3. Additionally, the upper shoe 3 has at the opposite ends in the direction perpendicular to the bridge axis stepped portions 33 and 33 each of which is formed centrally with a cutout 35 to form projections 34 and 34 at the bridge-axially opposite sides of the cutout 35. The cutouts 35 and 35 receive the respective arms 22 and 22 of the lower shoe 2 such as to form a clearance for allowing a limited degree of erected girder expansion and contraction in the bridge-axial direction. The upper shoe 3 has a flat lower surface 32 in sliding contact with the flat surface 82 of the bearing plate 8 constituting a movable section 4 placed on the concave surface 21 of the lower shoe 2 and has an upper surface 31 for sliding contact with the sole plate 12 after girder erection.

On the other hand, the sole plate 12 is formed in its lower surface with a downward facing center recess 121 mating with the upward facing center recess 37 of the upper shoe 3 and is formed at the bridge-axially opposite ends with bolt holes 122 and 122 mating with the respective holes 36 and 36 of the upper shoe 3. The downward facing recess 121 is formed centrally with a hole 123 extending to the upper surface of the sole plate 12 and a nut 124 is fixed on the upper surface of the sole plate 12 to cover the hole 123. In the downward facing recess 121 of the sole plate 12, there is received a stopper piece 500 which is threadedly fixed to the nut 124 fixed on the upper surface of the sole plate 12 and is suspended within the downward facing recess 121 by a mounting bolt 600 extending through the hole 123. The sole plate 12 is previously fixed such as by anchor bolts to the girder G upon girder formation at such a position that the sole plate 12 can be placed in agreement with the support structure 1 installed on the bridge pier B and abutment after girder erection. The lower surface of the sole plate 12 is flattened on a level with the lower surface of the girder G. The mounting bolt 600 suspending the stopper piece 500 within the downward facing recess 121 of the sole plate 12 is placed in a hole 700 extending through the girder G. Mortar M or the like is poured into the hole 700 to imbed the mounting bolt 600 in the girder G after the stopper piece 500 is placed in the upward facing cylindrical recess 37 of the upper shoe 3.

A girder erection method using the above-described support structure will now be described. In the same manner as previously stated, the sole plate 12 is fixed at a predetermined position of the girder G and then the girder G is placed on the movable plate 63 of the support structure. The girder G is continuously advanced axially of the bridge (in the arrow Y direction of FIG. 13) until the sole plate 12 arrives at the predetermined position of the support structure 1. At the arrival of the sole plate 12 at the predetermined position, the downward facing recess 121 of the sole plate 12 comes in agreement with the upward facing recess 37 of the upper shoe 3. Under these conditions, the mounting bolt 600 connected to the stopper piece 500 is turned so as to move the stopper piece 500 received in the downward facing recess 121 of the sole plate 12 into the upward facing recess 37 of the upper shoe 3 until the stopper piece 500 is placed in both of the downward and upward facing recesses. Thereafter, bolts are inserted through the holes 36 and 36 of the upper shoe 3 and threadedly engaged in the bolt holes 122 and 122 of the sole plate 12 to fix the sole plate 12 to the upper shoe 3.

The stopper piece 500 placed in both of the upward facing recess 37 of the upper shoe and the downward facing recess 121 of the sole plate 12 to engage the sole plate 12 with the upper shoe 3 is more effective to positively support the girder G under horizontal loads exerting on the girder G after girder erection.

Figure 3:
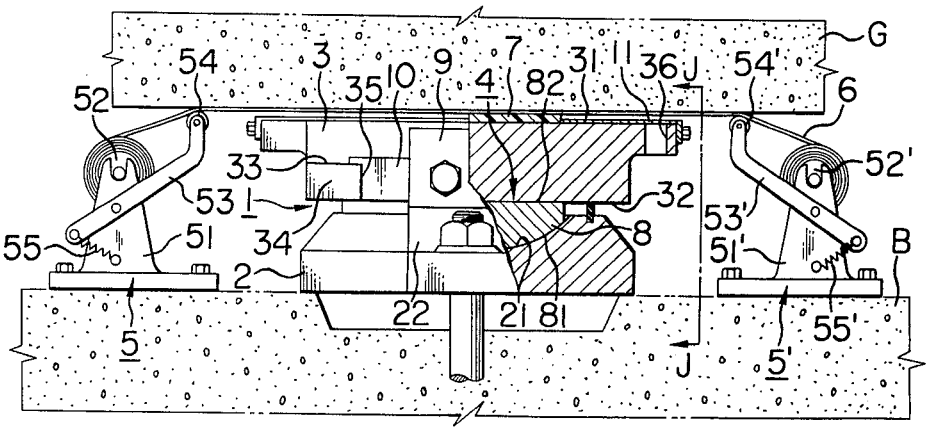
FIG. 3 is a fragmentary sectional side view showing the support structure embodying one form of the present invention with a concrete bridge girder being advanced.
Figure 4:
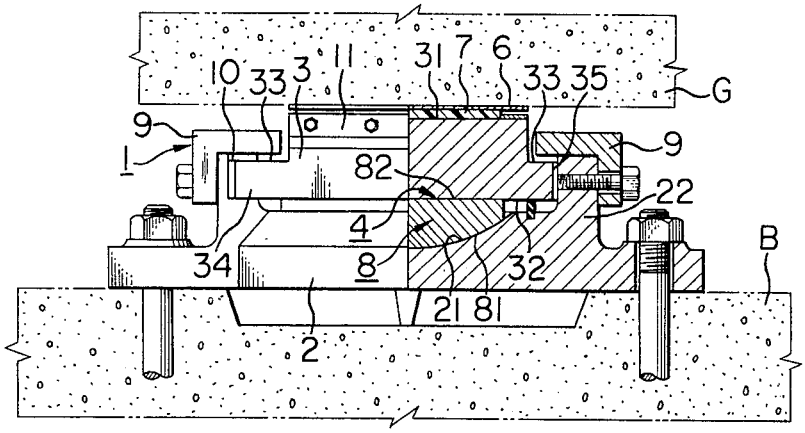
FIG. 4 is a fragmentary longitudinal section taken along the line J—J of FIG. 3.
Figure 5:
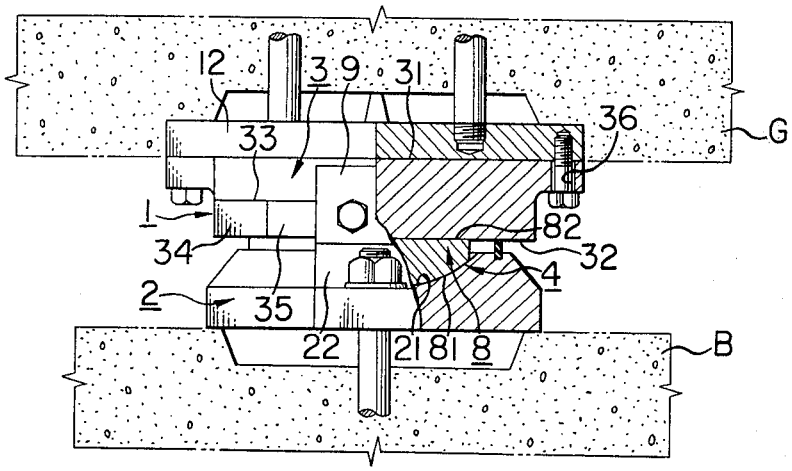
FIG. 5 is a fragmentary longitudinal section showing the support structure after girder erection.
Figure 6:
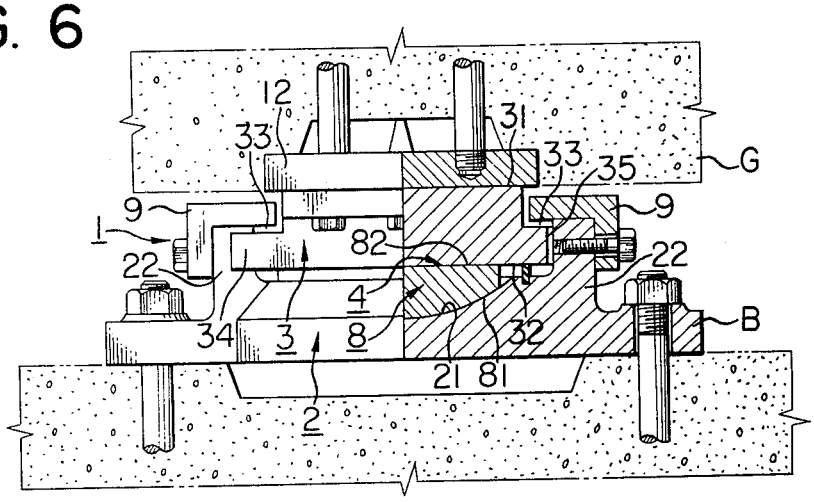
FIG. 6 is a fragmentary longitudinal section of the support structure of FIG. 5, FIGS. 7, 8 and 9 are sectional views showing different types of movable plate for use in the support structure of the present invention.

Although the above girder erection method has been described in connection with the movable section 4 of the type as shown in FIG. 3 including a bearing plate 8, it is to be understood, of course, that the movable section may be as illustrated in FIG. 11 or 12.

What is claimed is:

1. A concrete girder support structure for use in a cantilever erection method comprising an upper shoe for fixing to a girder through a sole plate fixed thereto at a predetermined position, a lower shoe fixed to a pier abutment, a movable part disposed between the upper and lower shoes, and a movable plate on the upper shoe for bridge-axial movement relative to the upper shoe, a sliding member provided between the movable plate and the upper surface of the upper shoe, a first holder device at one end of said movable plate, and, a second holder device at the side of the lower shoe, the other end of the movable plate being wound as it slides by said second holder device, whereby the girder having the sole plate fixed thereto at a predetermined position and carried on the movable plate can be continuously moved together with the movable plate through the assistance of the sliding member.

2. A support structure as set forth in claim 1, in which the movable plate is formed of a thin steel plate.

3. A support structure as set forth in claim 2, in which the movable plate is a composite plate having a thin steel plate and a rubber resilient plate integrally provided over one surface of the thin steel plate.

4. A support structure as set forth in claim 2, in which the moving plate is a composite plate having a rubber resilient plate sandwiched as a unit by two thin steel plates.

5. A support structure as set forth in claim 1, comprising said sliding member provided, between the movable plate and the upper shoe being fixedly held on the upper surface of the upper shoe so that the movable plate carrying the girder thereon is movable in sliding contact with the sliding member.

6. A support structure as set forth in claim 1, said sliding member of the movable plate is being integrally provided on its surface.

7. A support structure as set forth in claim 1, in which stopper members are provided between the upper and lower shoes for restricting bridge-axial movement of the upper shoe with respect to the lower shoe upon girder erection.

8. A support structure as set forth in claim 7, in which the stopper members are disposed between cutouts formed on the upper shoe and arms formed on the lower shoe.

9. A concrete bridge girder support structure for use in cantilever erection, comprising an upper shoe for fixture to the girder through a sole plate fixed thereto at a predetermined position, the upper shoe formed on its upper surface with an upward facing center recess, a lower shoe fixed on a pier and abutment, a movable section disposed between the upper and lower shoes, a long movable plate placed for bridge-axial movement relative to the upper shoe, the sole plate formed in its lower surface with a downward facing center recess corresponding to the upward facing recess of the upper shoe, a stopper means suspended within the downward facing recess by a mounting bolt extending through the girder such that it can be placed in both of the upward and downward facing recesses by turning movement of the mounting bolt to restrict horizontal movement of the sole plate with respect to the upper shoe when the downward facing recess of the sole plate comes in agreement with the upward facing recess of the upper shoe, whereby the girder having the sole plate fixed thereto at the predetermined position and carried on the movable plate can be continuously moved axially of the bridge together with the movable plate.

10. A support structure as claimed in claim 9 including a sliding member disposed between the movable plate and the upper surface of the upper shoe.

11. A concrete bridge girder cantilever erection method using a support structure including an upper shoe for fixture to the girder through a sole plate fixed thereto at a predetermined position, a lower shoe fixed on a bridge pier and abutment, a movable section disposed between the upper and lower shoes, and a long movable plate placed for bridge-axial movement relative to the upper shoe, comprising the steps of driving a pushing device directly installed on the pier or girder to continuously slide the movable plate carrying thereon the girder forward along the upper shoe together with the movable plate up to a predetermined erection position at which the sole plate comes in agreement with the upper shoe of the support structure, removing the movable plate and the pushing device, and fixing the sole plate integrally to the upper shoe.

12. A concrete bridge girder cantilever erection method as set forth in claim 11, wherein said movable plate is supported at its one end to a holder device so that the girder on said movable plate is movable by a holder device said movable plate by said holder device.

13. A concrete bridge girder cantilever erection method as set forth in claim 12, wherein said movable plate is supported at both ends by a pair of holder device provided at both sides of the lower shoe.

14. A concrete bridge girder cantilever erection method as set forth in claim 13, in which a vertical jack and the support structure are installed on the pier and which includes the steps of driving the pushing device directly installed on the pier or girder to continuously slide the girder having the sole plate fixed thereto at the predetermined position and carried on the movable plate together with the movable plate along the upper shoe of the support structure up to the erection position at which the sole plate comes in agreement with the upper shoe of the support structure, driving the vertical jack to lift up the girder for removal of the movable plate and the pushing device, driving the vertical jack to lower the girder to place the sole plate on the upper shoe, integrally fixing the sole plate to the upper shoe, and removing the vertical jack.

15. A concrete bridge girder cantilever erection method as set forth in claim 14, wherein stopper members are disposed between the upper and lower shoes of the support structure for restricting bridge-axial movement of the upper shoe with respect to the lower shoe upon girder erection.

16. A concrete bridge girder cantilever erection method as set forth in claim 15, in which the stopper members are disposed between cutouts formed on the upper shoe and arms formed on the lower shoe.

17. A concrete bridge girder cantilever erection method as set forth in claim 16, in which the stopper members are removed after girder erection to form a clearance between the cutouts of the upper shoe and the arms of the lower shoe so that the support structure can serve as a movable bearing allowing a limited distance of bridge-axial movement of the girder after girder erection.

18. A concrete bridge girder cantilever erection method as set forth in claim 16, in which the stopper members are left fixed so that the support structure can serve as a fixed bearing restricting bridge-axial movement of the girder after girder erection.

19. A support structure as claimed in claim 11 including a sliding member disposed between the movable plate and the upper surface of the upper shoe.

* * * * *